US006561360B1

(12) United States Patent
Kalm et al.

(10) Patent No.: US 6,561,360 B1
(45) Date of Patent: May 13, 2003

(54) AUTOMATIC TRAY HANDLING SYSTEM FOR SORTER

(75) Inventors: W Scott Kalm, Plano, TX (US); Douglas E Olson, Grand Rapids, MI (US); Gerald A Brouwer, Grandville, MI (US); Ricardo N Schiesser, Grandville, MI (US); David H Cotter, Coopersville, MI (US)

(73) Assignee: Rapistan Systems Advertising Corp., Grand Rapids, MI (US)

( * ) Notice: Subject to any disclaimer, the term of this patent is extended or adjusted under 35 U.S.C. 154(b) by 0 days.

(21) Appl. No.: 09/831,068

(22) PCT Filed: Mar. 8, 2000

(86) PCT No.: PCT/EP00/02002

§ 371 (c)(1),
(2), (4) Date: May 4, 2001

(87) PCT Pub. No.: WO00/53344

PCT Pub. Date: Sep. 14, 2000

Related U.S. Application Data

(60) Provisional application No. 60/123,484, filed on Mar. 9, 1999.

(51) Int. Cl.[7] ..... B07C 5/36

(52) U.S. Cl. ..... 209/606; 209/651; 209/900; 414/265; 198/346.1; 198/465.1

(58) Field of Search ..... 209/606, 552, 209/651, 653, 900, 917, 921; 414/265; 198/347.1, 347.2, 347.3, 433, 468.01, 468.9, 468.11, 469.1, 474.1, 576, 346.1, 465.1

(56) References Cited

U.S. PATENT DOCUMENTS

| | | | | |
|---|---|---|---|---|
| 4,151,447 A | | 4/1979 | Von der Heide et al. | 318/135 |
| 4,253,573 A | * | 3/1981 | Dubberly et al. | 209/525 |
| 4,468,165 A | * | 8/1984 | Kawasaki | 198/465.1 |
| 4,530,199 A | * | 7/1985 | Manservisi et al. | 209/536 |
| 4,624,617 A | | 11/1986 | Belna | 414/347 |
| 4,627,540 A | * | 12/1986 | Takeda | 100/4 |

(List continued on next page.)

FOREIGN PATENT DOCUMENTS

| | | | | |
|---|---|---|---|---|
| EP | 0438667 A2 | * | 7/1991 | B07C/5/36 |
| EP | 0495661 A2 | | 7/1992 | B07C/3/18 |
| EP | 0761322 A1 | | 3/1997 | B07C/3/06 |
| EP | 0774303 A2 | | 5/1997 | B07C/3/08 |
| FR | 2620053 A1 | * | 3/1989 | B07C/3/06 |
| WO | WO 9934936 | | 7/1999 | B07C/3/08 |

OTHER PUBLICATIONS

Commonly assigned, co–pending U.S. patent application, entitled Axle Holding Yoke for Conveyor Roller, Ser. No. 09/418,297, filed Oct. 4, 1999, by Ricardo Schiesser.

*Primary Examiner*—Donald P. Walsh
*Assistant Examiner*—Mark J. Beauchaine
(74) *Attorney, Agent, or Firm*—Van Dyke, Gardner, Linn & Burkhart, LLP

(57) ABSTRACT

An automatic tray-handling system for use with a mail sorter (26) having a plurality of tray supporters, comprises a transporter (50) having a conveying surface (56) and an insertion/extraction assembly (58); and respective feed **(44*a*, 44*b*) and discharge conveyors (46*a*, 46*b*) adapted to feed empty trays (38) to the transporter conveying surface (56) and receiving at least partially full trays (38) from the transporter conveying surface. The insertion/extraction assembly (58) is adapted to insert empty trays (38) to tray support areas and remove at least partially full trays (38) from tray support areas. The conveying surface operational is adapted to receive empty trays (38) from the feed conveyor (44*a*, 44*b*) and at least partially full trays (38) from the insertion/extraction assembly (58). Moreover from the conveying surface empty trays are dischargeable to the insertion/extraction assembly (58) and to the discharge conveyor (46*a*, 46*b*)**.

40 Claims, 15 Drawing Sheets

U.S. PATENT DOCUMENTS 5,263,300 A 11/1993 Plent et al. ..... 53/244
5,385,243 A 1/1995 Jackson et al. ..... 209/509
5,588,520 A 12/1996 Affaticati et al. ..... 198/370.06
5,718,321 A 2/1998 Brugger et al. ..... 198/359
5,803,704 A 9/1998 Lazzarotti ..... 414/793.4
5,915,568 A * 6/1999 Wu ..... 209/552
5,959,868 A 9/1999 Oppliger et al. ..... 364/478.14
6,024,425 A 2/2000 Imai et al. ..... 312/35
6,026,967 A 2/2000 Isaacs et al. ..... 209/539
6,431,369 B1 * 8/2002 Boller et al. ..... 209/615

* cited by examiner

AUTOMATIC TRAY HANDLING SYSTEM FOR SORTER

This application claims the benefit of Provisional Application No. 60/123,484 filed Mar. 9, 1999.

This invention relates to tray-handling equipment for removing full or partially full trays from a mail sorter and replenishing the mail sorter with empty trays. The invention is particularly useful with flat mail sorters.

A flat mail sorter of the type marketed by Mannesmann Dematic Rapistan Corp. under Model No. FSM-100 is commercially available. Such flat sorter sorts flat mail, such as magazines, large envelopes, and the like to trays, typically plastic trays, each one devoted to a particular zip code. There is a requirement that full trays be removed from their respective support shelf and replaced with an empty tray. There is also a requirement that an occasional sweep operation be accommodated. A sweep operation is one in which all of the trays are removed from their respective shelves, even if only partially full. The empty shelves are then stocked with empty trays.

This tray-handling function is traditionally performed manually. It is desirable to automate this manual function. In addition to performing the functions carried out manually, it is desirable that an automatic tray-handling system allow manual tray replacement should the automatic tray-handling system be unusable for whatever reason.

Objects, advantages and features of the present invention will become apparent upon review of the following specification in conjunction with the drawings.

Figure 1:
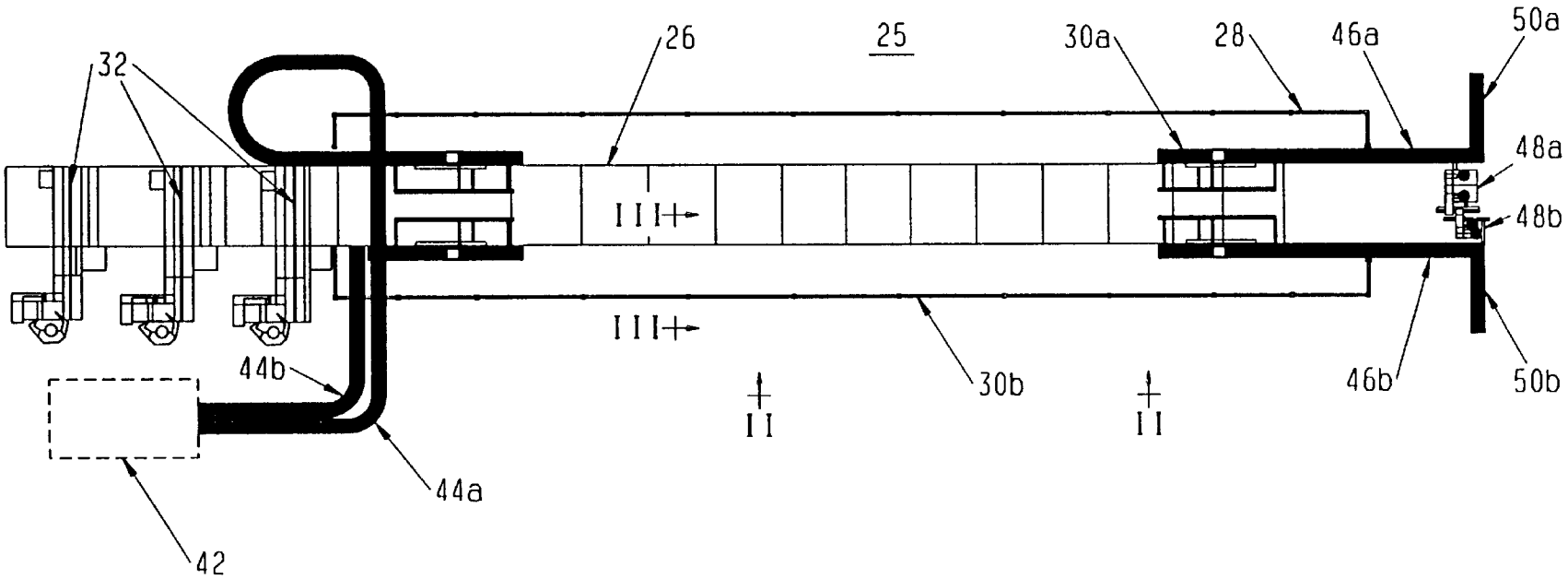
FIG. 1 is a plan view of a flat mail sorter including an automatic tray-handling system, according to the invention.
Figure 2:
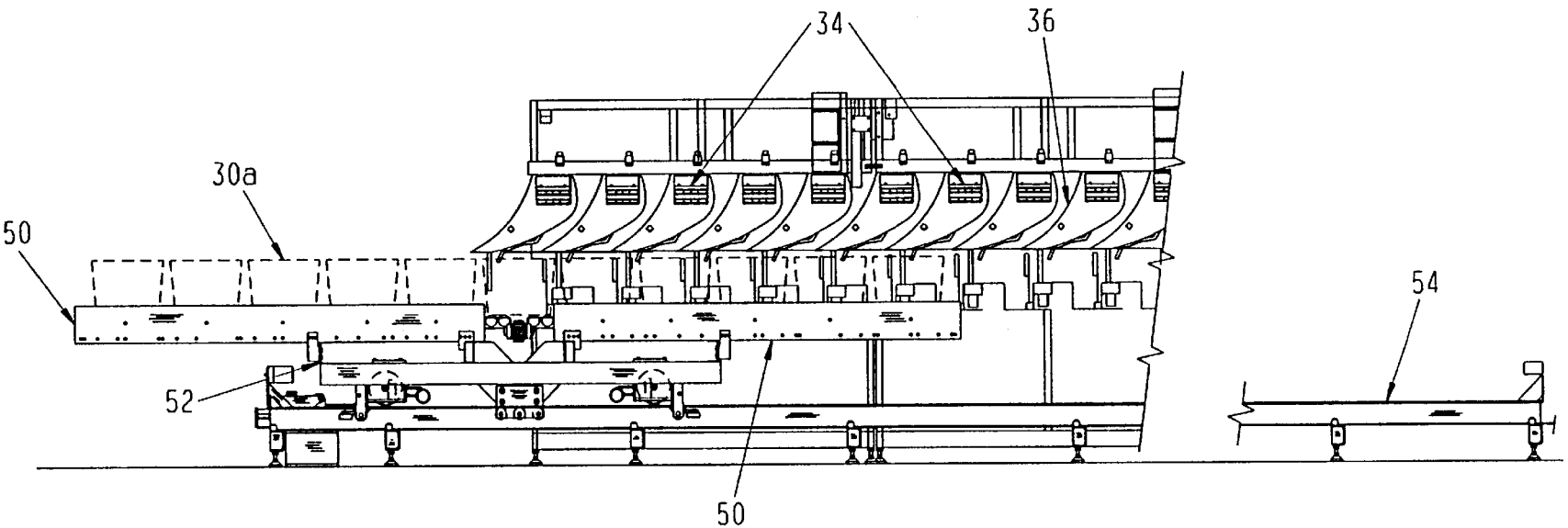
FIG. 2 is a side elevation taken along the lines II—II in FIG. 1.
Figure 3:
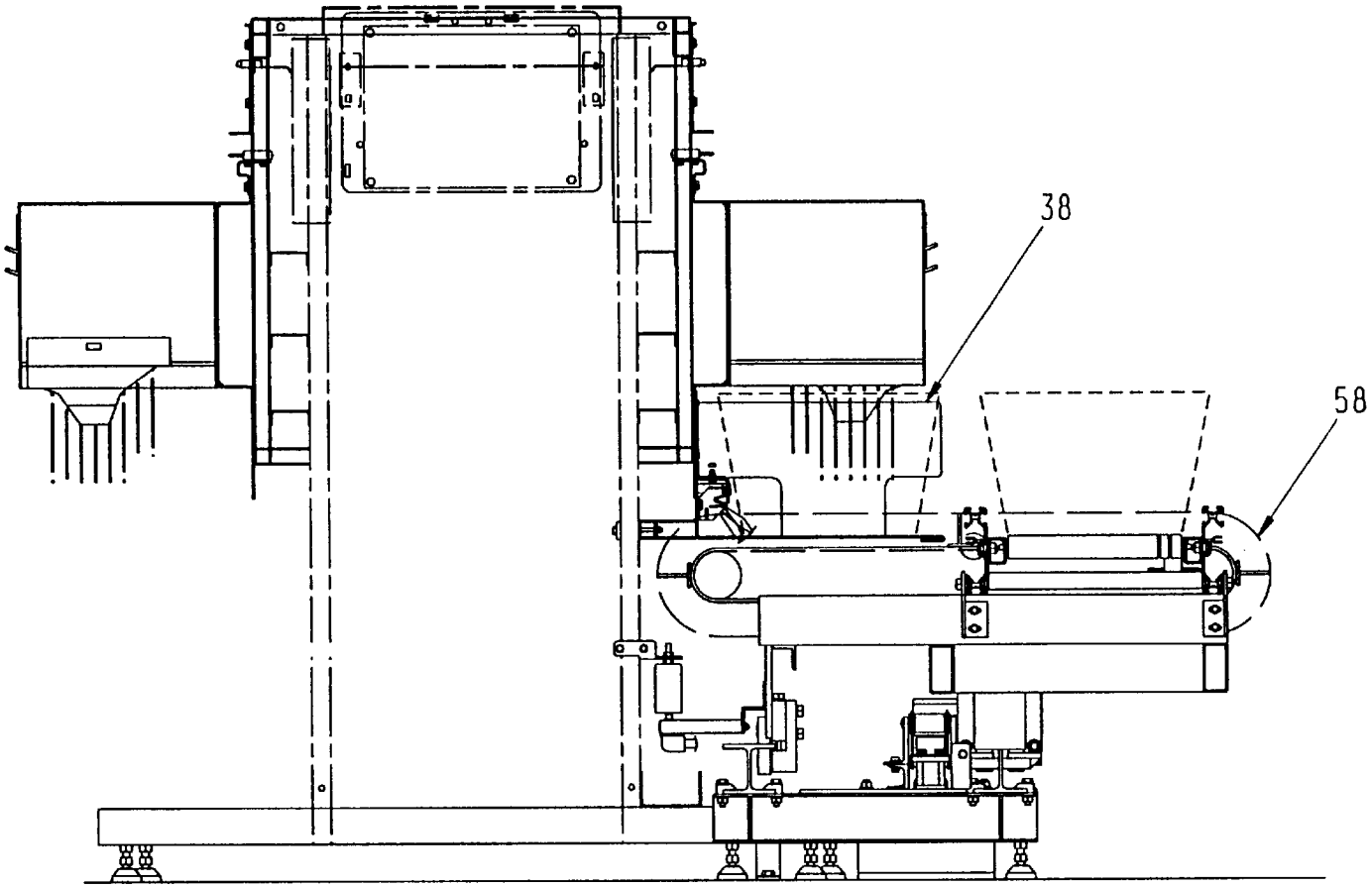
FIG. 3 is a sectional view taken along the lines III—III in FIG. 1.
Figure 4:
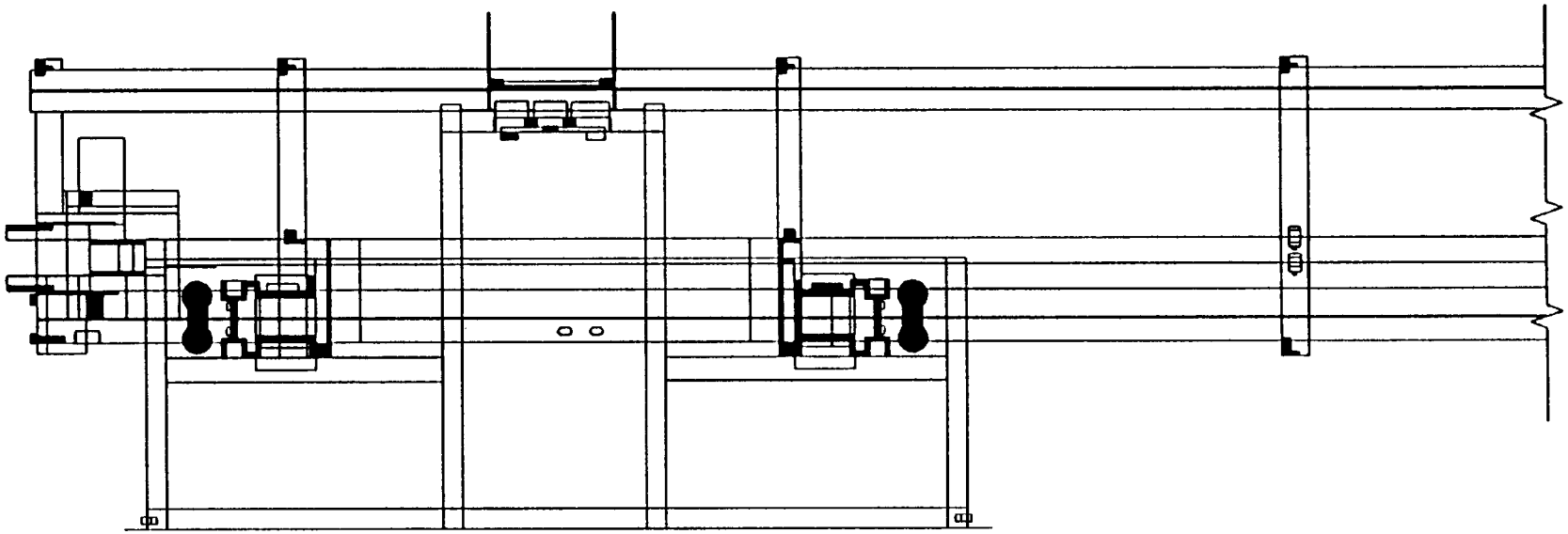
FIG. 4 is a plan view of the apparatus shown in FIG. 2.

Referring now specifically to the drawings, and the illustrative embodiments depicted therein, a flat mail sorter system 25 includes a flat mail sorter generally illustrated at 26 and an automatic tray-handling system generally illustrated at 28. The automatic tray-handling system includes two substantially identical portions including automatic tray-handling subsystem 30*a* and automatic tray-handling subsystem 30*b*, each to service identical portions of the sorter system. For ease of description, only one automatic tray-handling subsystem will generally be described.

Flat mail sorter 26 is a Model FSM-100 flat sorter which is commercially available for Mannesmann Dematic Rapistan Corp. in Grand Rapids, Mich. It includes one or more injectors 32 which inject mail into buckets 34 arranged in a carousel, each of which carries one piece of mail. A computer (not shown) causes the bucket 34 to open above a chute 36 causing the mail to be deposited in a tray 38. Tray 38 is positioned on a shelf 40 which has a slot or channel in its bottom support surface (not shown).

Automatic tray-handling subsystem 28 may include a stacker area 42 which feeds empty trays onto a feed conveyor 44*a* associated with tray-handling subsystems 30*a* and 44*b* associated with tray-handling subsystem 30*b*. Automatic tray-handling system 28 additionally includes a discharge conveyor 46*a* associated with tray-handling subsystems 30*a* and discharge conveyor 46*b* associated with tray-handling subsystem 30*b*. A label printer and application 48*a* is positioned adjacent discharge conveyor 46*a* and a label printer and application 48*b* is located adjacent discharge conveyor 46*b*. Such printer and applicators are commercially available from numerous sources. A reject conveyor 50*a* extends from discharge conveyor 46*a* opposite label printer and applicator 48*a* in order to receive trays whose labels cannot be read by a scanner positioned adjacent the label printer and application. A reject conveyor 50*b* extends from discharge conveyor 46*b* adjacent label printer and applicator 48*b* for the same purpose. Trays which make it past reject conveyors 50*a*, 50*b* are discharged to the right as illustrated in FIG. 1.

Automatic tray-handling system 30*a* includes a transporter 50 having a carriage 52 which travels laterally on a set of rails 54, a conveyor assembly 56 supported on carriage 52, and an insertion/extraction assembly 58 operatively associated with conveyor 56. Preferably, insertion/extraction assembly 58 is positioned in the general center of conveyor 56.

Figure 7:
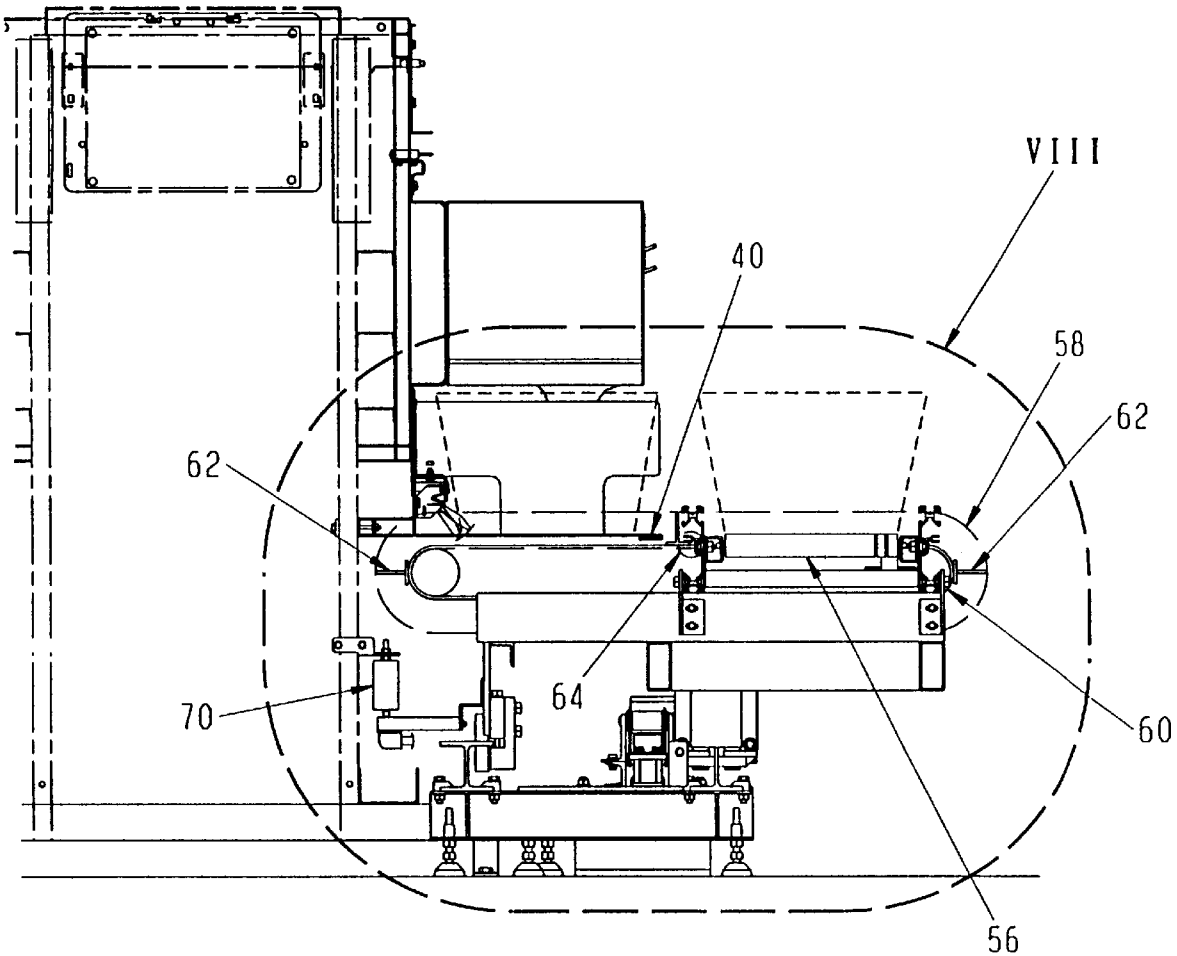
FIG. 7 is the same view as FIG. 5 with the automatic tray-handling system operational.
Figure 8:
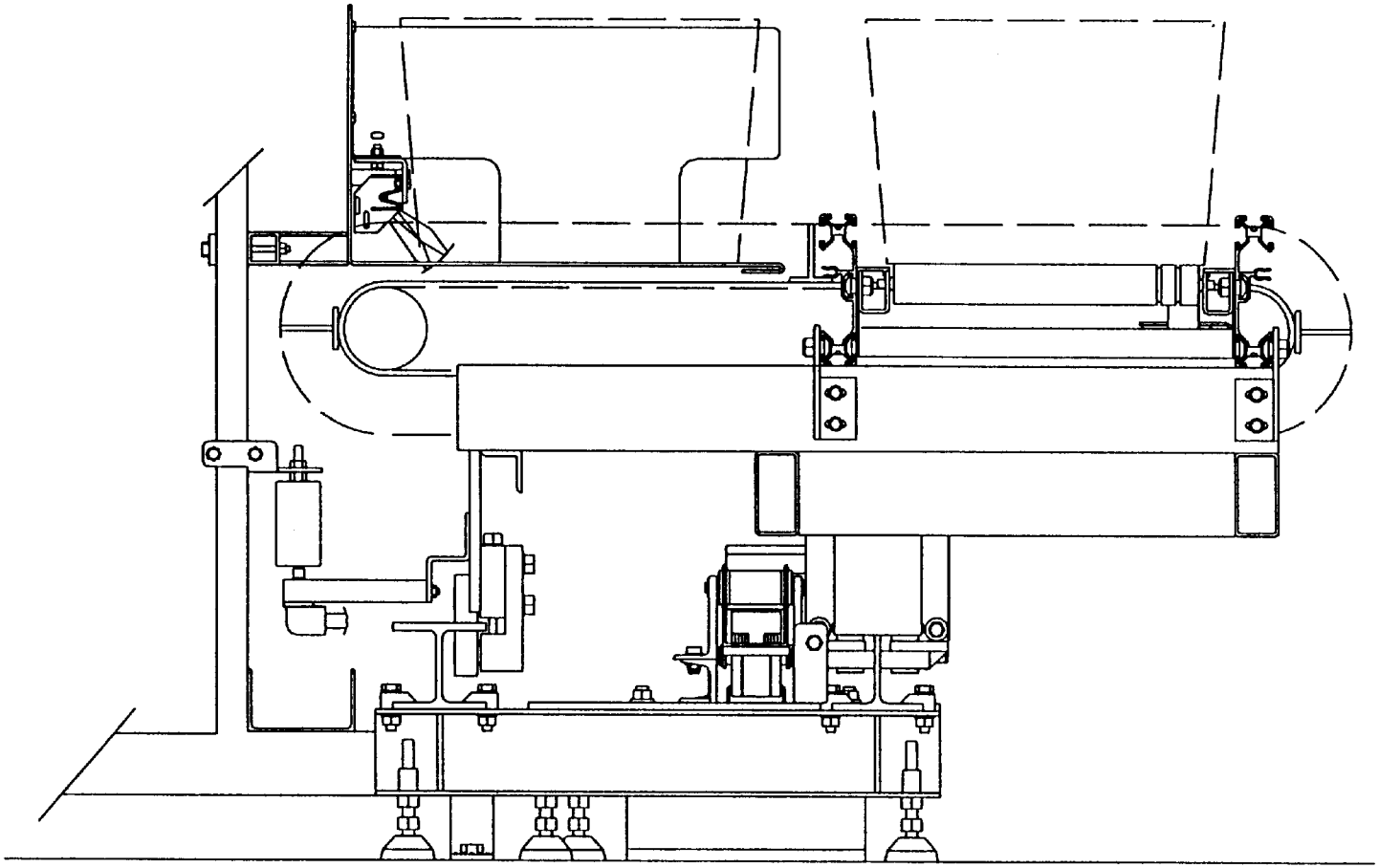
FIG. 8 is an enlargement of the area shown at VIII in FIG. 7.
Figure 9:
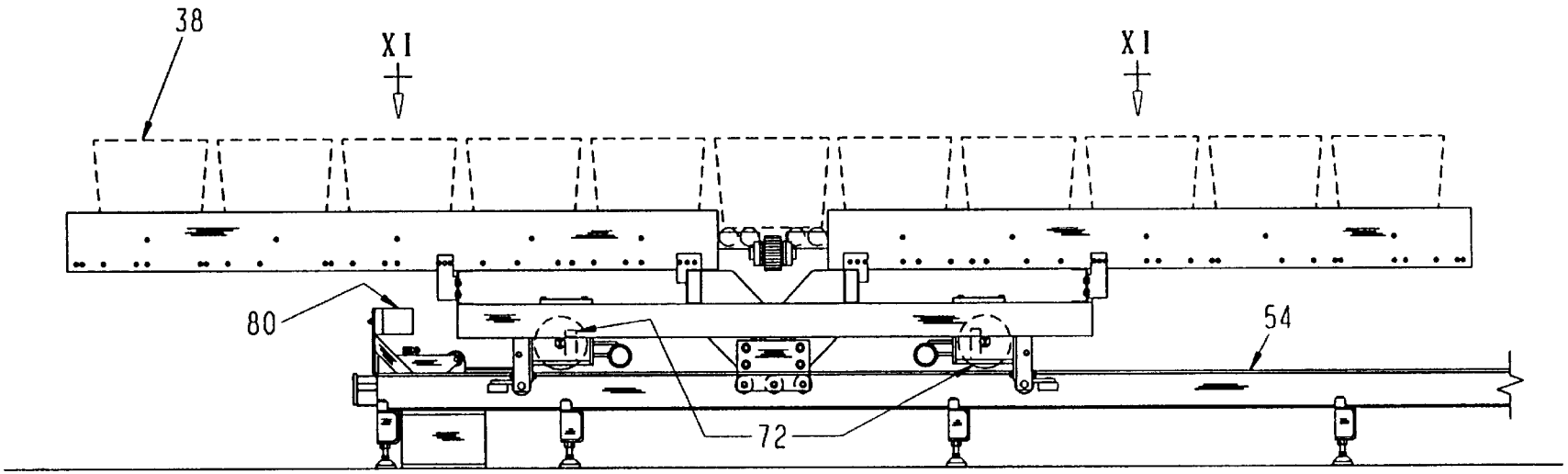
FIG. 9 is the same view as FIG. 2 showing the automatic tray-handling system.
Figure 10:
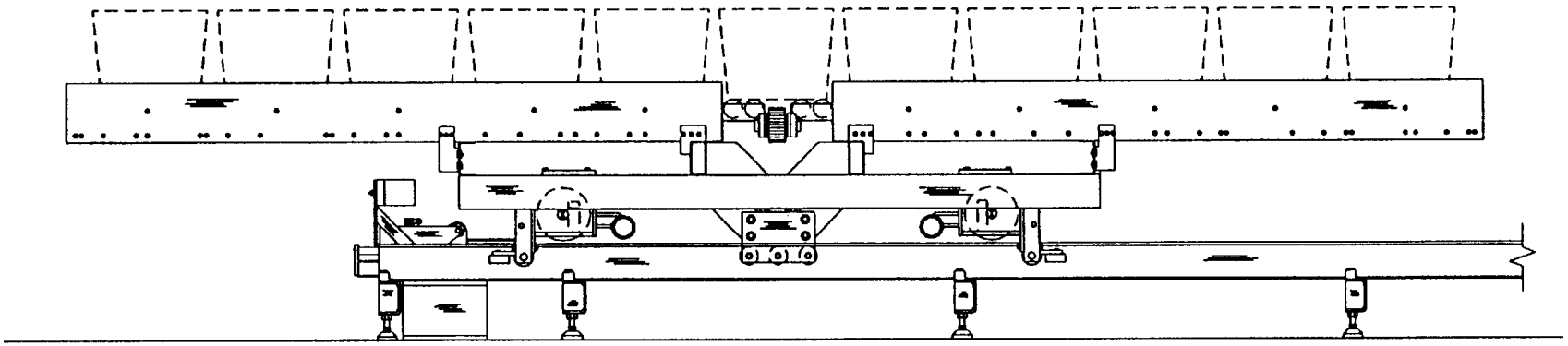
FIG. 10 is the same view as FIG. 9, but enlarged.
Figure 11:
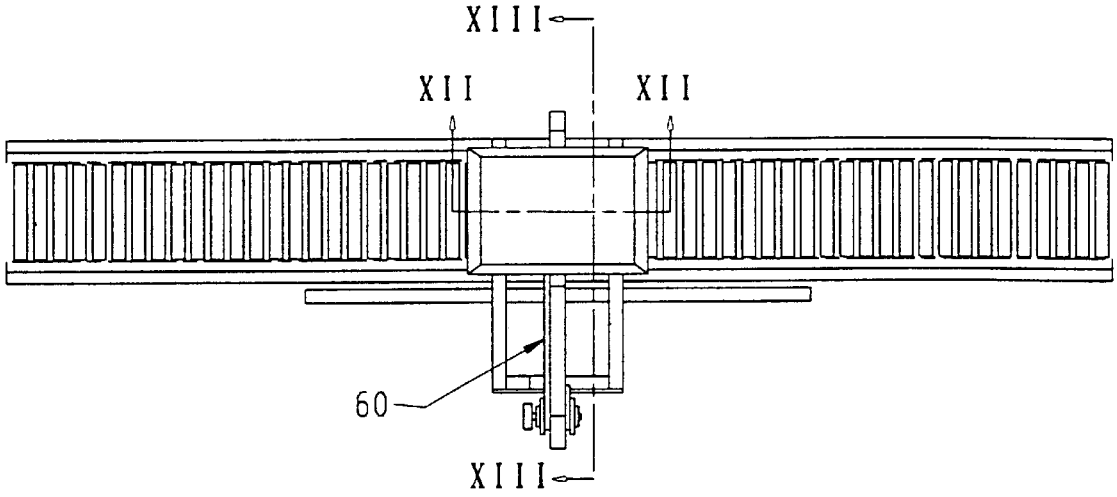
FIG. 11 is a view taken along the lines XI—XI in FIG. 9.
Figure 12:
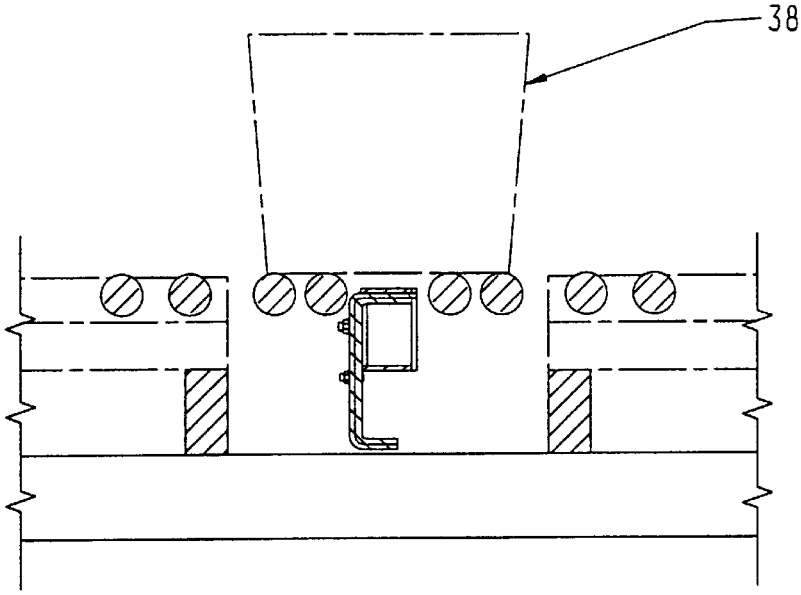
FIG. 12 is a sectional view taken along the lines XII—XII in FIG. 11.
Figure 14:
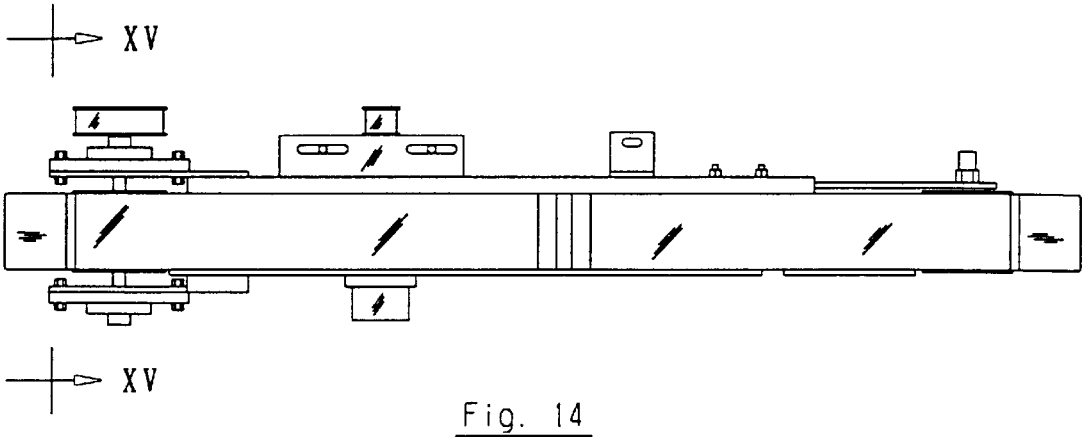
FIG. 14 is a view taken along the lines XIV—XIV in FIG. 13.
Figure 13:
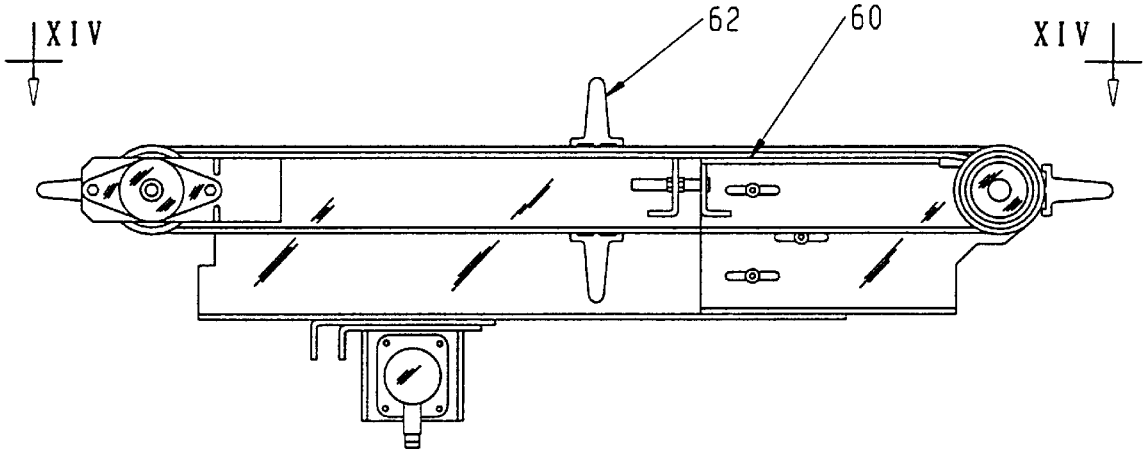
FIG. 13 is a sectional view taken along the lines XIII—XIII in FIG. 11.
Figure 15:
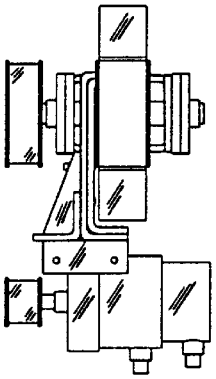
FIG. 15 is a view taken along the lines XV—XV in FIG. 14.
Figure 16:
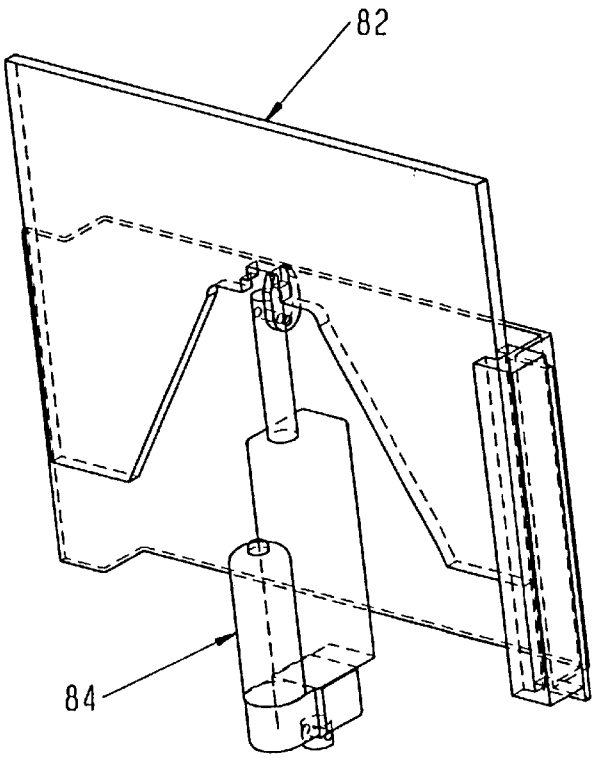
FIG. 16 is a perspective view of a movable stop useful with the invention.
Figure 19:
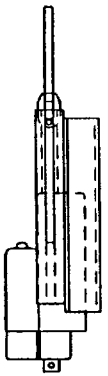
FIG. 19 is a view taken along the lines XIX—XIX in FIG. 18.
Figure 18:
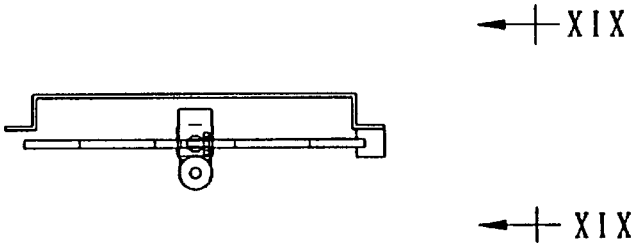
FIG. 18 is a view taken along the lines XVIII—XVIII in FIG. 17.
Figure 17:
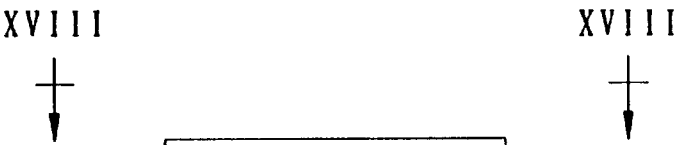
FIG. 17 is an end elevation of the stop in FIG. 16.
Figure 20:
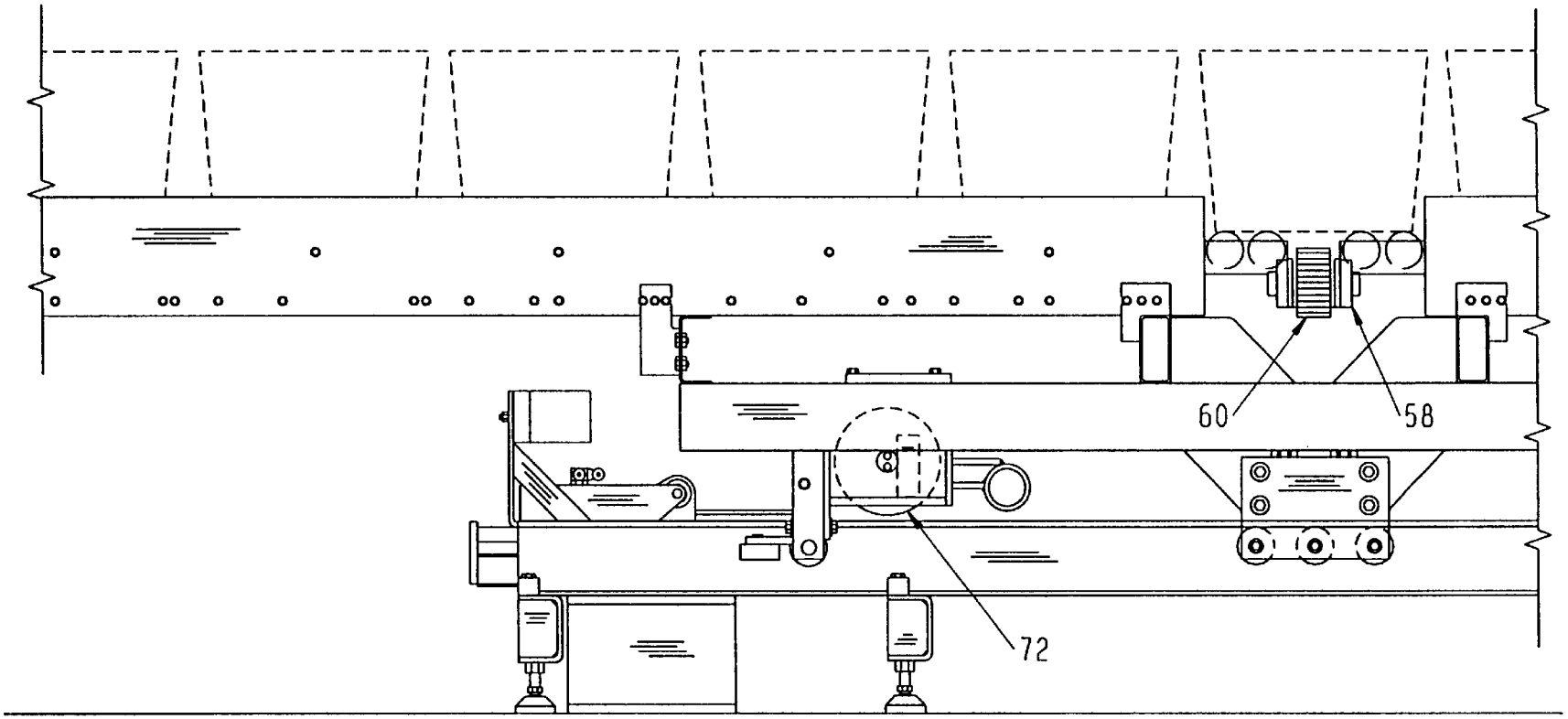
FIG. 20 is an enlarged side elevation of an automatic tray-handling system, according to the invention.
Figure 21:
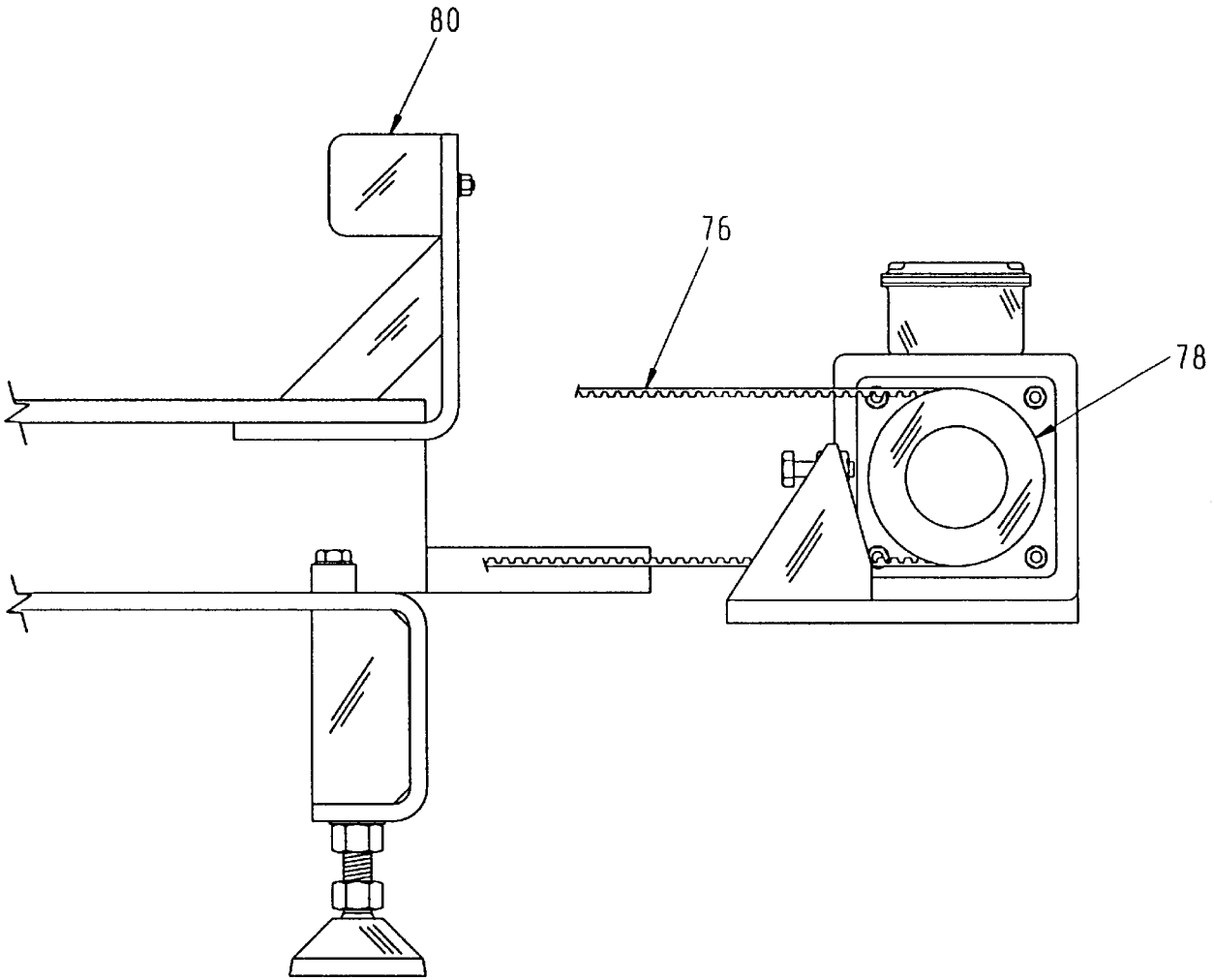
FIG. 21 is an extension of FIG. 20 as viewed to the right in FIG. 20.

Insertion/extraction assembly 58 includes a belt 60, which is preferably a cog belt, which is precisely controlled by a servo motor (not shown). Up to four attachments 62 are substantially equally spaced along belt 60 and perform the function of inserting trays from conveyor 56 to a shelf 40 and extracting a tray from a shelf 40 to conveyor 56. In particular, as viewed in FIG. 7, a tray is inserted to shelf 40 by rotating belt 60 in a counterclockwise fashion causing attachment 62 to engage the tray and slide the tray to the left as viewed in FIG. 7. In order to extract a tray from shelf 40 and move the tray onto conveyor 56, belt 60 is rotated clockwise, as viewed in FIG. 7, causing the tray to move from shelf 40 to the right to conveyor 56. A pair of passive rollers 64 assist in the transfer motion between conveyor 56 and shelf 40.

Conveyor 56 includes a frame 66 and a plurality of motorized rollers 68 positioned between the frame members.

Figure 6:
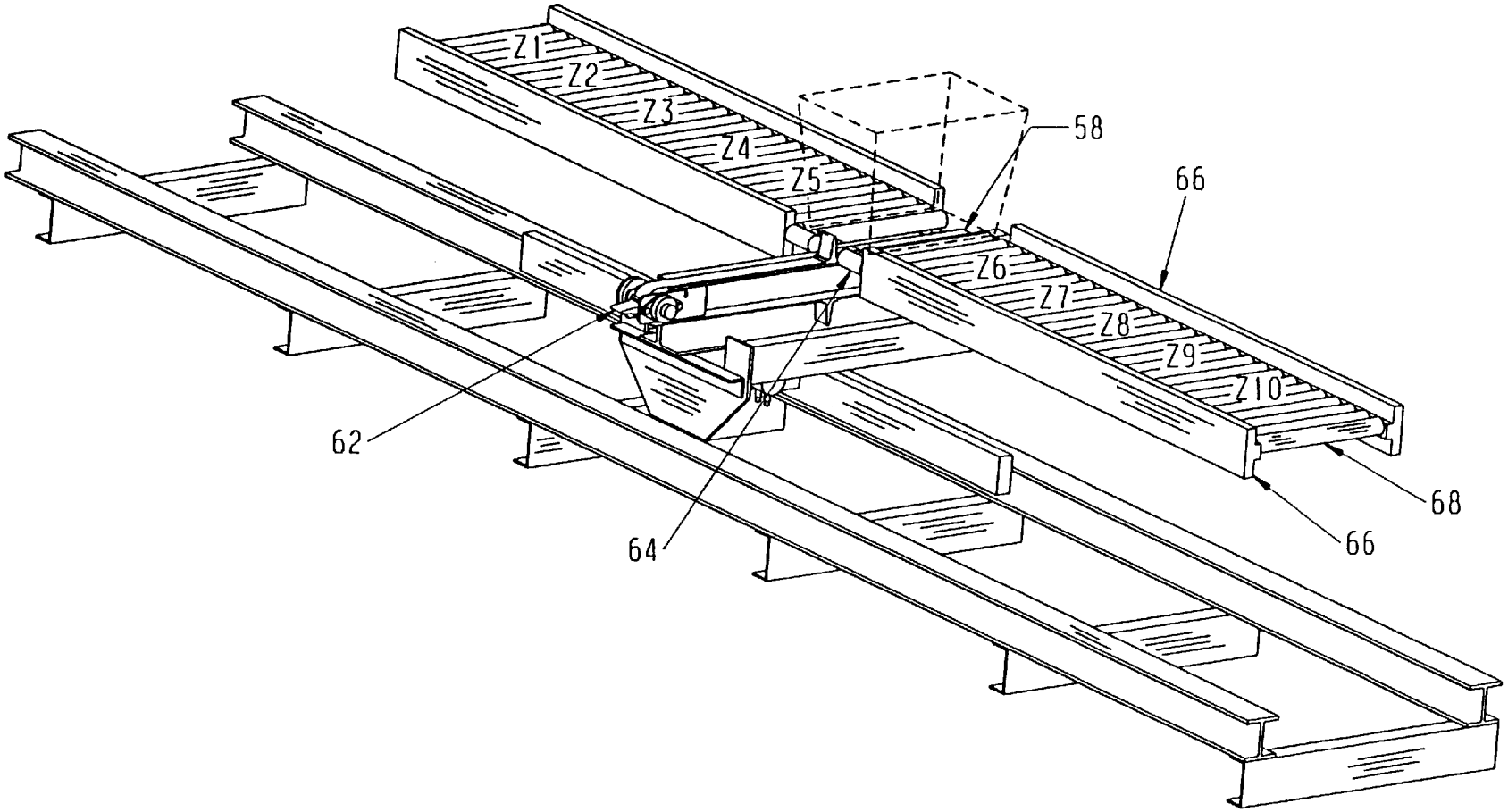
FIG. 6 is a perspective view taken generally from the sorter location looking outwardly of an automatic tray-handling system, according to the invention.

Preferably, a certain number of rollers 68 are motorized rollers of the type which are commercially available from Interroll and other manufacturers with the remaining rollers being passive rollers coupled to the motorized rollers in a conventional manner. Rollers 68 are arranged in five zones on each side of insertion/extraction assembly 58. The rollers in each zone are operated in unison and are capable of movement in both lateral directions. In particular, rollers 68 are arranged in the illustrated embodiment in 10 zones (FIG. 6). Zones Z1–Z5 are arranged to the right of insertion/extraction assembly 58 as viewed in the direction looking at flat mail sorter 26. Zones Z6–Z10 are located to the left of insertion/extraction assembly 58 as viewed looking toward flat mail sorter 26.

Carriage 52 receives electrical power from a commercially available power takeoff 70 and receives data signals from an infrared communication link (not shown). A pair of wheels 72 provide primary support for carriage 52 as it rides along on rail 54. Balancing rollers 74 engage the other rail 54 in order to prevent tipping of carriage 52. Carriage 52 is transported along rails 54 by a cog belt 76 whose ends are attached to carriage 52. A stationary servo motor 78 drives cog belt 76 in a manner which precisely positions carriage 52 at a location under the control of a computer-based control (not shown). A pair of bumpers or buffers 80 prevent carriage 52 from traveling off rails 54 in the event of a breakdown of the control system.

The automatic tray-handling system operates as follows. During a non-sweep operation of system 25; i.e., when full trays are being removed and replaced with empty trays, empty trays will be initially positioned in zones Z6–Z10 of transporter 50. When mail sorter 26 indicates that a particular tray on a shelf 40 is full, carriage 52 is moved in order to position insertion/extraction assembly 58 juxtaposed with the full tray. Belt 60 is actuated in order to extract the tray which is then transported by conveyor 56 to zone Z1. An empty tray is moved from zone Z6 into juxtaposition with insertion/extraction assembly 58 which then inserts the empty tray onto the shelf from which the full tray was removed. When the next full tray is handled, the full tray is removed by insertion/extraction assembly 58 and transported by conveyor 52 to zone Z2. The empty tray that was in zone Z7 is inserted by insertion/extraction assembly 58 onto the empty shelf. This process is repeated until full trays are present on zones Z1–Z5 and zones Z6–Z10 are empty. Carriage 52 is then transported to a position juxtaposed with discharge conveyor 46*b*. Zones Z1–Z5 are actuated to transport the full trays from conveyor 56 to discharge conveyor 46*b*. Carriage 52 is then transported into a position juxtaposed with feed conveyor 44*b*. Conveyor 56 is then actuated in order to transport five empty trays onto zones Z6–Z10. Transporter 50 is now ready for replacing more full trays with empty trays and transporting the full trays to discharge conveyor 46*b*.

The second mode of operation occurs when it is desired to sweep flat mail sorter 26 of all trays whether full or partially full. During the sweep mode, transporter 50 starts out with no trays on conveyor 56. Carriage 52 is sequentially moved along the first 10 shelves and trays, whether full or partially full, are sequentially loaded onto conveyor 56 until all zones Z1–Z10 are full. Carriage 52 is then transported into a position juxtaposed with discharge conveyor 46*b* and all 10 trays are discharged. This process is carried out until all full and partially full trays are removed from flat mail sorter 26. Carriage 52 is then juxtaposed with feed conveyor 44*a* and 10 empty trays are positioned on conveyor 56. Carriage 52 then moves along the first 10 shelves and insertion/extraction assembly 58 positions empty trays on the 10 shelves. Carriage 52 then returns to feed conveyor 44*a* in order to receive 10 additional empty trays which are then placed on the next 10 shelves. This process is carried out until all shelves are filled with empty trays. Alternatively, the steps of removing 10 partially full trays could be immediately followed by replacing those shelves with empty trays.

Carriage 52 may also include one or more movable gates 82 on one or both sides of insertion/extraction assembly 58. Gate 82 is vertically actuated by an actuator 84. The purpose of gate 82 is in order to square up a tray 38 prior to insertion of that tray onto a shelf 40. Thus, gate or gates 82 are raised by actuator 84 after a tray has been moved by conveyor 56 into position on insertion/extraction 58 but prior to insertion of the tray on the juxtaposed shelf 40. After the tray is inserted, actuator 84 retracts the gate 82.

Figure 5:
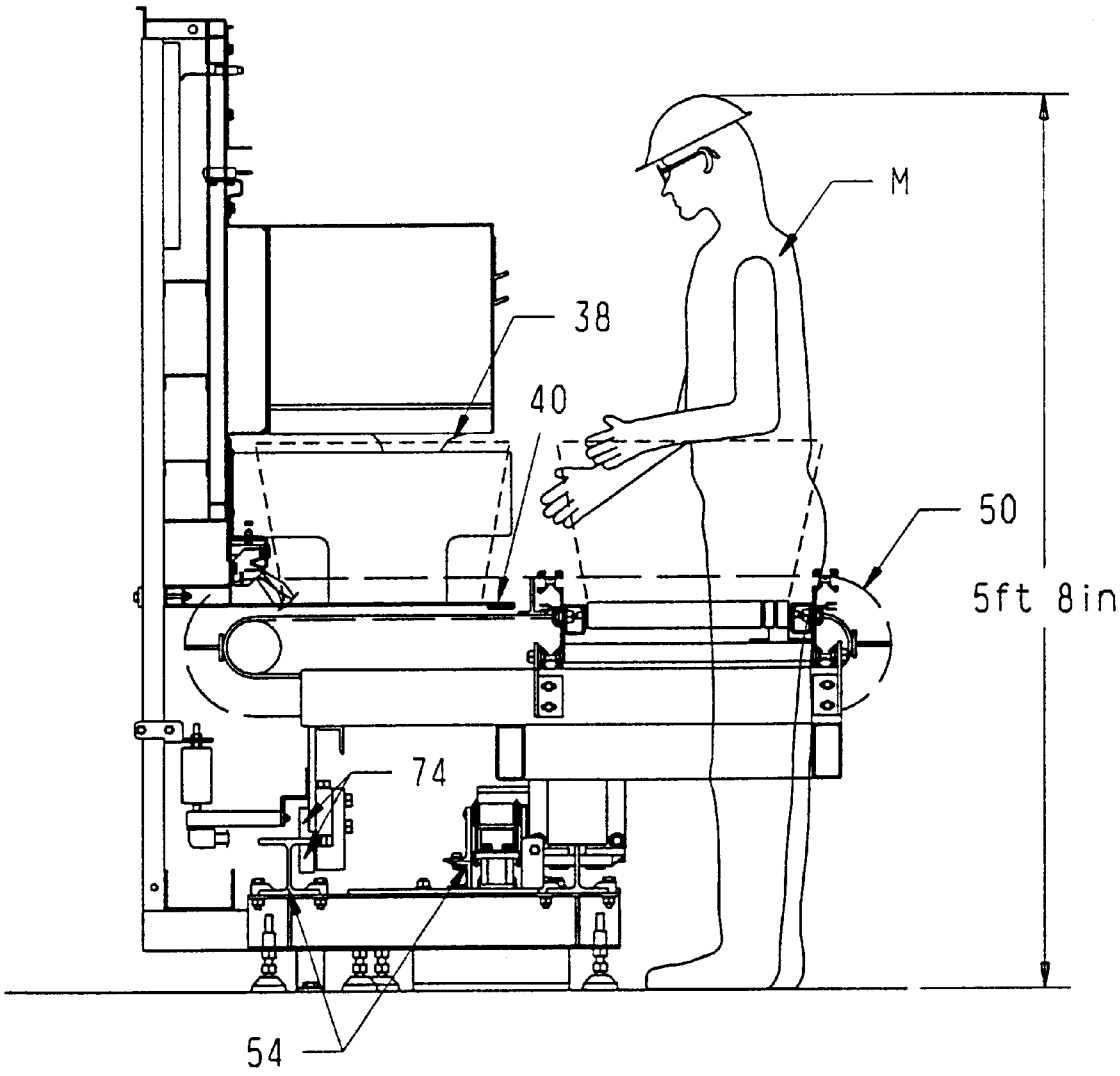
FIG. 5 is an enlarged view similar to FIG. 3 showing a manual operator utilizing the flat sorter when the automatic tray-handling system is not in operation.

As can be seen in FIG. 5, an operator M can easily access trays 38 on shelves 40 when automatic tray-handling system 28 is not operational. In such mode, transporter 50 would be moved to a position away from the sorter. The only portion of the tray-handling system which operator M would need to work around are rails 54, which pose only a minor obstacle to the operator. Therefore, automatic tray-handling system 28 conveniently accommodates manual tray-handling, when necessary.

It should be understood that although the invention is illustrated for use with 10 trays positioned on conveyor 56, the system could be designed to handle fewer than 10 or more than 10 trays. Furthermore, depending upon the configuration of the flat mail sorter, it could be desirable to stack multiple conveyors 56 and insertion/extraction assemblies 58 on top of each other in order to service trays which are stacked on multiple vertically arranged shelves.

LIST OF REFERENCE-NUMBERS

25 flat mail sorter system
26 flat mail sorter
28 automatic tray-handling subsystem
30*a* tray-handling subsystem
30*b* tray-handling subsystem
32 injector
34 buckets
36 chute
38 tray
40 shelf
42 stacker area
44*a* feed conveyor
44*b* feed conveyor
46*a* discharge conveyor
46*b* discharge conveyor
48*a* lable printer and application
48*b* lable printer and application
50 transporter
50*a* reject conveyor
50*b* reject conveyor
52 carriage
54 set of rails
56 conveyor assembly
58 insertion/extraction assembly
60 belt
62 attachments
64 passive rollers
66 frame
68 rollers
70 takeoff
72 pair of wheels

74 balancing rollers
76 cog belt
78 servo motor
80 buffers
82 gate
84 actuator
M operator
Z1–Z10 zone

What is claimed is:

1. An automatic tray-handling system for use with a mail sorter having a plurality of tray support areas, comprising:

a transporter having a conveying surface and an insertion/extraction assembly; and respective feed and discharge conveyors adapted to feed empty trays to the transporter conveying surface and receive at least partially full trays from the transporter conveying surface; said transporter conveying surface being configured to be generally horizontally aligned with the tray support areas; said insertion/extraction assembly adapted to insert empty trays to tray support areas and remove at least partially full trays from tray support areas; said conveying surface operational to receive empty trays from the feed conveyor and at least partially full trays from the insertion/extraction assembly, said conveying surface operational to discharge empty trays to the insertion/extraction assembly and to the discharge conveyor.

2. The system in claim 1 wherein said transporter includes a carriage which supports said conveying surface and said insertion/extraction assembly and which is moveable between said feed and discharge conveyors and the tray support areas of the mail sorter.

3. The system in claim 1 wherein said insertion/extraction assembly comprises an endless member which is moveable in one direction to insert trays on the tray support areas and in an opposite direction to remove trays from the tray support areas.

4. The system in claim 3 including a plurality of attachments on said endless member to apply a force to a tray on the endless member.

5. The system in claim 1 including at least one gate adjacent said insertion/extraction assembly adapted to align a tray prior to insertion on a tray support area.

6. The system in claim 1 wherein said conveying surface comprises a plurality of rollers which are arranged in zones and which are selectively driven in opposite directions.

7. The system in claim 6 wherein at least some of said rollers are motorized rollers.

8. The system in claim 1, wherein said transporter is movable to position said insertion/extraction assembly at the tray support areas.

9. A method of selectively and automatically replacing at least partially full trays on a mail sorter having a plurality of tray support areas, comprising:

providing a transporter having a conveying surface and an insertion/extraction assembly;

supplying a plurality of empty trays on the conveying surface;

moving the transporter to position the insertion/extraction assembly adjacent a tray that is at least partially full;

extracting the at least partially full tray with the insertion/extraction assembly;

positioning the at least partially full tray on the conveying surface; and inserting an empty tray from the conveying surface to the tray support areas with the insertion/extraction assembly.

10. The method of claim 9 including juxtaposing said transporter conveying surface with a discharge conveyor to discharge at least partially full trays from the conveying surface.

11. The method of claim 10 including juxtaposing said transporter conveying surface with a feed conveyor to receive empty trays on the conveying surface.

12. The method of claim 9 including:

sweeping substantially all trays from the mail sorter tray support areas; and substantially filling the tray support areas with empty trays, including moving the transporter to sequentially position the insertion/extraction assembly adjacent tray support areas and removing trays from the tray support areas with the insertion/extraction assembly while positioning the removed trays on the conveying surface.

13. The method of claim 12 further including juxtaposing the transporter conveying surface with a discharge conveyor to discharge the removed trays from the conveying surface.

14. The method of claim 13 further including juxtaposing the transporter conveying surface with a feed conveyor to substantially fill the transporter conveying surface with empty trays.

15. The method of claim 14 including moving the transporter to sequentially position the insertion and extraction assembly adjacent empty tray support areas and inserting trays from the conveying surface with the insertion and extraction assembly to the empty tray support areas.

16. A method of automatically sweeping substantially all trays from mail sorter tray support areas and automatically substantially filling the tray support areas with empty trays on a mail sorter having a plurality of tray support areas, comprising:

providing a transporter having a conveying surface and an insertion/extraction assembly;

moving the transporter to sequentially position the insertion/extraction assembly adjacent tray support areas; and removing trays from the tray support areas with the insertion/extraction assembly while positioning the removed trays on the conveying surface.

17. The method of claim 12 further including juxtaposing the transporter conveying surface with a discharge conveyor to discharge the removed trays from the conveying surface.

18. The method of claim 16 further including juxtaposing the transporter conveying surface with a feed conveyor to substantially fill the transporter conveying surface with empty trays.

19. The method of claim 18 including moving the transporter to sequentially position the insertion/extraction assembly adjacent empty tray support areas and inserting trays from the conveying surface with the insertion/extraction assembly to the empty tray support areas.

20. An automatic tray-handling system for use with a mail sorter having a plurality of tray support areas, comprising:

a transporter;

an insertion and extraction assembly; and respective feed and discharge conveyors adapted to feed empty trays to the transporter and receive at least partially full trays from the transporter, said transporter being configured to be generally horizontally aligned with the tray support areas, said insertion and extraction assembly being adapted to insert empty trays to tray support areas and remove at least partially full trays from tray support areas, said transporter being operable to receive empty trays from the feed conveyor and at least partially full trays from the insertion and extraction assembly, said transporter being operable to discharge empty trays to the insertion and extraction assembly and to the discharge conveyor, said transporter being generally horizontally aligned with the tray support areas.

21. The system in claim 20, wherein said transporter is movable to position said insertion and extraction assembly adjacent to the tray support areas of the mail sorter.

22. The system in claim 20, wherein said transporter includes a carriage which supports a conveying surface and said insertion and extraction assembly and which is movable between said feed and discharge conveyors and the tray support areas of the mail sorter.

23. The system in claim 22, wherein said conveying surface comprises a plurality of rollers which are arranged in zones and which are selectively driven in opposite directions.

24. The system in claim 23, wherein at least some of said rollers are motorized rollers.

25. The system in claim 20, wherein said insertion and extraction assembly comprises an endless member which is movable in one direction to insert trays on the tray support areas and in an opposite direction to remove trays from the tray support areas.

26. The system in claim 25 including a plurality of attachments on said endless member to apply a force to a tray on the endless member.

27. The system in claim 20, wherein said transporter is movable to position said insertion and extraction assembly at the tray support areas.

28. A method of selectively and automatically replacing at least partially full trays on a mail sorter having a plurality of tray support areas, comprising:

providing a transporter and an insertion and extraction assembly;

supplying a plurality of empty trays on the transporter;

moving the transporter to position the insertion and extraction assembly adjacent to a tray support area supporting a tray that is at least partially full; and extracting the at least partially full tray with the insertion and extraction assembly, positioning the at least partially full tray on the transporter and inserting an empty tray from the transporter to the tray support area with the insertion and extraction assembly.

29. The method of claim 28 including juxtaposing said transporter with a discharge conveyor to discharge at least partially full trays from the transporter.

30. The method of claim 29 including juxtaposing said transporter with a feed conveyor to receive empty trays on the transporter.

31. The method of claim 30 including sweeping substantially all trays from the mail sorter tray support areas and substantially filling the tray support areas with empty trays.

32. The method of claim 31 including:

moving the transporter to sequentially position the insertion and extraction assembly adjacent tray support areas; and removing trays from the tray support areas with the insertion and extraction assembly while positioning the removed trays on the transporter.

33. The method of claim 32 including:

moving the transporter to sequentially position the insertion and extraction assembly adjacent empty tray support areas; and inserting trays from the transporter with the insertion and extraction assembly to the empty tray support areas.

34. An automatic tray-handling system for use with a mail sorter having a plurality of tray support areas, comprising:

a transporter;

an insertion and extraction assembly; and respective feed and discharge conveyors adapted to feed empty trays to the transporter and receive at least partially full trays from the transporter, said insertion and extraction assembly being adapted to insert empty trays to tray support areas and remove at least partially full trays from tray support areas, said transporter being operable to receive empty trays from the feed conveyor and at least partially full trays from the insertion and extraction assembly, said transporter being operable to discharge empty trays to the insertion and extraction assembly and to the discharge conveyor, said transporter being movable to position said insertion and extraction assembly at the tray support areas.

35. The system in claim 34, wherein said transporter includes a carriage which supports a conveying surface and said insertion and extraction assembly and which is movable between said feed and discharge conveyors and the tray support areas of the mail sorter.

36. The system in claim 35, wherein said conveying surface comprises a plurality of rollers which are arranged in zones and which are selectively driven in opposite directions.

37. The system in claim 36, wherein at least some of said rollers are motorized rollers.

38. The system in claim 34, wherein said insertion and extraction assembly comprises an endless member which is movable in one direction to insert trays on the tray support areas and in an opposite direction to remove trays from the tray support areas.

39. The system in claim 38 including a plurality of attachments on said endless member to apply a force to a tray on the endless member.

40. The system in claim 38, wherein said transporter generally is horizontally alignable with the tray support areas.

* * * * *